US009332858B1

(12) United States Patent
Chiang et al.

(10) Patent No.: US 9,332,858 B1
(45) Date of Patent: May 10, 2016

(54) TOWEL SYSTEM WITH ADJUSTABLE PADDED HEADREST

(71) Applicants: Greg Chiang, Bridgewater, NJ (US); Matthew Scudder, Lincoln Park, NJ (US)

(72) Inventors: Greg Chiang, Bridgewater, NJ (US); Matthew Scudder, Lincoln Park, NJ (US)

( * ) Notice: Subject to any disclaimer, the term of this patent is extended or adjusted under 35 U.S.C. 154(b) by 0 days.

(21) Appl. No.: 14/611,912

(22) Filed: Feb. 2, 2015

Related U.S. Application Data

(63) Continuation-in-part of application No. 13/849,358, filed on Mar. 22, 2013, now abandoned.

(51) Int. Cl.

| | |
|---|---|
| ***A47C 31/11*** | (2006.01) |
| ***A47G 9/06*** | (2006.01) |
| ***A47C 7/62*** | (2006.01) |
| ***A47G 9/10*** | (2006.01) |
| *A47K 10/02* | (2006.01) |
| *A47C 1/14* | (2006.01) |

(52) U.S. Cl.
CPC . *A47C 31/11* (2013.01); *A47C 7/62* (2013.01); *A47G 9/062* (2013.01); *A47G 9/1045* (2013.01); *A47C 1/14* (2013.01); *A47C 1/143* (2013.01); *A47K 10/02* (2013.01)

(58) Field of Classification Search
CPC ..... A47G 9/06; A47G 9/062; A47G 9/066; A47G 9/1045; A47K 10/00; A47K 10/02; A45C 3/10; A47C 1/14; A47C 1/143; A47C 31/10; A47C 31/11; A47C 31/113
USPC ..... 5/419, 417; 297/229
See application file for complete search history.

(56) References Cited

U.S. PATENT DOCUMENTS

| | | | | | |
|---|---|---|---|---|---|
| 1,930,942 | A | | 10/1933 | Pringle | |
| 3,689,947 | A | * | 9/1972 | Wolf | A47G 9/1045 5/419 |
| 4,200,942 | A | | 5/1980 | Case | |
| D280,170 | S | | 8/1985 | Short | |
| 4,553,785 | A | * | 11/1985 | Duke, Jr. | A47C 31/11 297/188.2 |
| 4,725,094 | A | * | 2/1988 | Greer | A47C 31/02 297/188.06 |
| 4,877,288 | A | * | 10/1989 | Lee | A47C 1/143 297/188.06 |
| D322,532 | S | | 12/1991 | Kumar et al. | |
| 5,072,467 | A | | 12/1991 | Hunt | |
| 5,261,131 | A | | 11/1993 | Kilby | |
| 5,275,463 | A | * | 1/1994 | Rocha | A47C 31/11 297/188.01 |
| D349,625 | S | | 8/1994 | Dapalma | |
| 5,361,435 | A | | 11/1994 | Reeves | |
| 5,467,487 | A | | 11/1995 | Sicard | |
| 5,620,229 | A | * | 4/1997 | Ledford | A47C 1/143 297/183.5 |
| D389,362 | S | | 1/1998 | Boulatian | |
| 5,729,846 | A | | 3/1998 | Sullivan | |
| 6,058,530 | A | | 5/2000 | Wheeler | |
| 6,149,234 | A | * | 11/2000 | Daniels | A47C 1/143 297/188.06 |

(Continued)

*Primary Examiner* — Nicholas Polito
*Assistant Examiner* — David R Hare

(57) ABSTRACT

A towel system with an adjustable padded headrest for laying over a portable lounge chair or directly on a ground surface. A rectangular towel is disposed on a lounge chair and secured to the lounge chair via attachment fasteners inserted into a hole of a row of attachment holes. A water-resistant pillow pouch is disposed on the towel. A pillow is removeably located inside the pillow pouch. The towel may alternatively be placed directly on a ground surface and secured to the ground via stakes inserted through apertures disposed on each corner of the towel.

4 Claims, 9 Drawing Sheets

(56) References Cited

U.S. PATENT DOCUMENTS

| | | | | |
|---|---|---|---|---|
| D440,805 | S | 4/2001 | Ragone et al. | |
| D450,970 | S * | 11/2001 | Self | D6/611 |
| 6,575,533 | B1 * | 6/2003 | Kicos | A47C 31/11 297/188.06 |
| D478,455 | S | 8/2003 | Papazian | |
| 6,616,225 | B2 * | 9/2003 | Graff | A47C 31/11 297/229 |
| 6,626,491 | B1 | 9/2003 | Blome et al. | |
| 6,859,960 | B1 | 3/2005 | Jerome | |
| D527,938 | S * | 9/2006 | Dandrea | D6/611 |
| 7,581,788 | B1 * | 9/2009 | Johnson | A47C 1/143 297/184.11 |
| 7,762,628 | B2 * | 7/2010 | Williams | A47C 1/143 297/228.1 |
| 8,016,484 | B1 * | 9/2011 | Cross | A45C 3/00 383/16 |
| D651,032 | S | 12/2011 | Adkins | |
| 8,122,538 | B2 * | 2/2012 | McBrearty | 5/417 |
| D707,987 | S * | 7/2014 | Chiang | D6/596 |
| 8,959,679 | B1 * | 2/2015 | Everds | A47G 9/062 206/38 |
| 9,072,393 | B2 * | 7/2015 | Friedman | A47C 31/11 |
| 2006/0010598 | A1 * | 1/2006 | Rusinak-Connors | A47G 9/062 5/417 |
| 2010/0001565 | A1 * | 1/2010 | Gray et al. | 297/229 |

* cited by examiner

TOWEL SYSTEM WITH ADJUSTABLE PADDED HEADREST

CROSS REFERENCE

This application claims priority to U.S. patent application Ser. No. 13/849,358, filed Mar. 22, 2013, the specification(s) of which is/are incorporated herein in their entirety by reference.

FIELD OF THE INVENTION

The present invention relates to chair and ground cover systems, or more specifically, systems featuring towels having an adjustable padded headrest that are laid over a top of a lounge chair or directly on the ground surface.

BACKGROUND OF THE INVENTION

The origination of the first towel is tied to the city of Bursa in Turkey to this day, noted for its production of "Turkish towels." There are many different types of towels in use in the present age including dish towels, bath towels, and beach towels. Often used for drying off after being in the water, the beach towel's main purpose is to provide a surface to lie on. The present invention features a towel system with an adjustable padded headrest for laying over a portable lounge chair or directly on the ground.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a towel system with an adjustable padded headrest for laying over a portable lounge chair or directly on a ground surface. In some embodiments, the system comprises a portable lounge chair. In some embodiments, the system comprises a rectangular towel.

In some embodiments, the system comprises a water-resistant pillow pouch located close to a towel top edge between a towel first edge and a towel second edge. In some embodiments, the system comprises a pillow removably located in the pillow pouch. In some embodiments, the towel is secured to the lounge chair via attachment fasteners inserted into a hole of a row of attachment holes.

DESCRIPTION OF PREFERRED EMBODIMENTS

Figure 1:
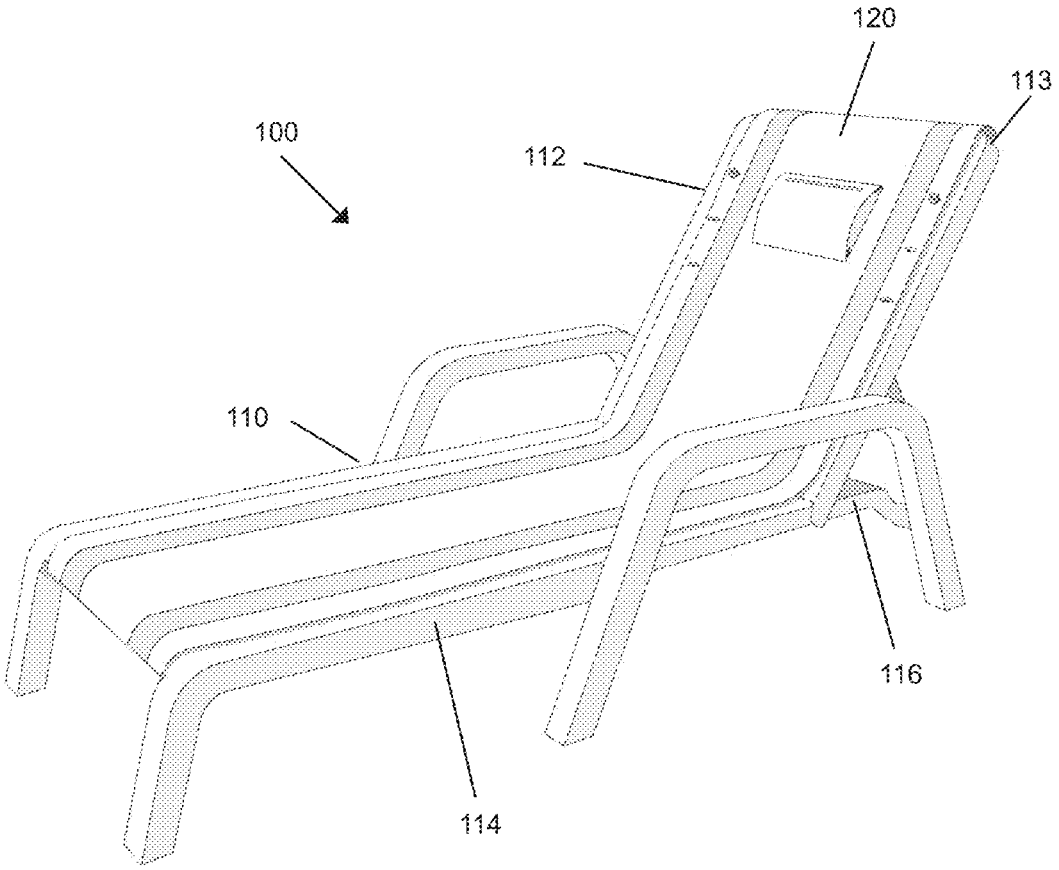
FIG. 1 shows a perspective view of a towel system of the present invention.
Figure 2:
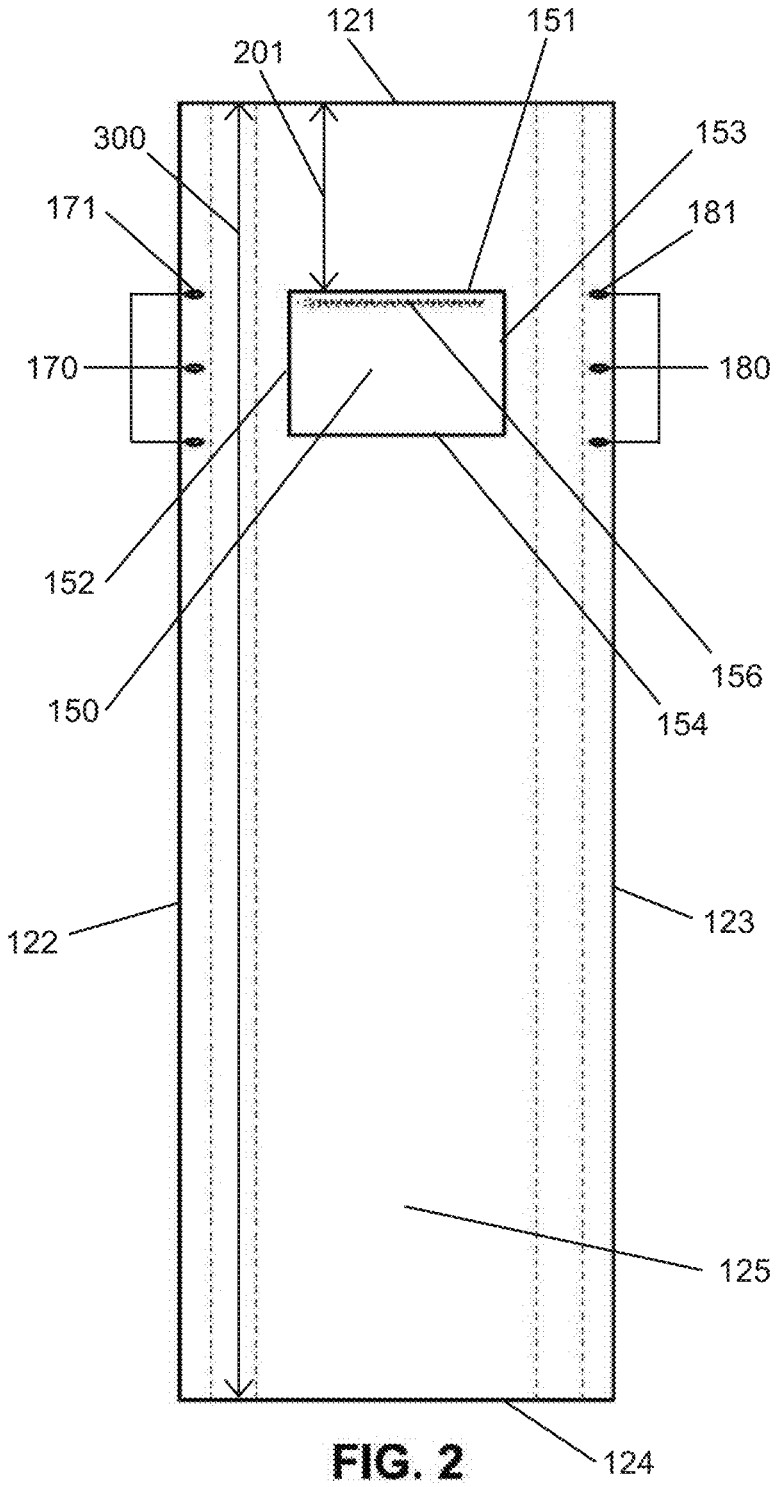
FIG. 2 shows a front view of the towel system.
Figure 3:
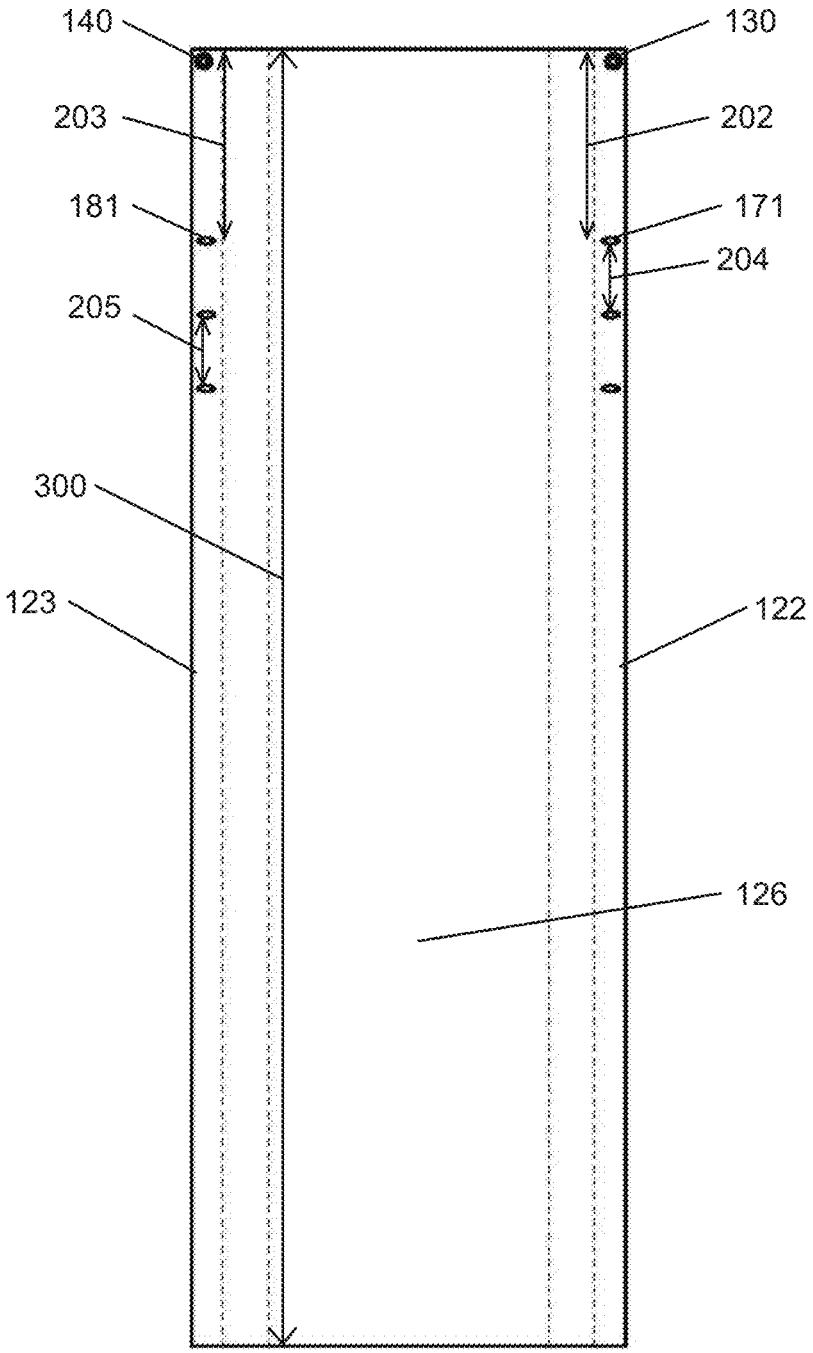
FIG. 3 shows a back view of the towel system.
Figure 4:
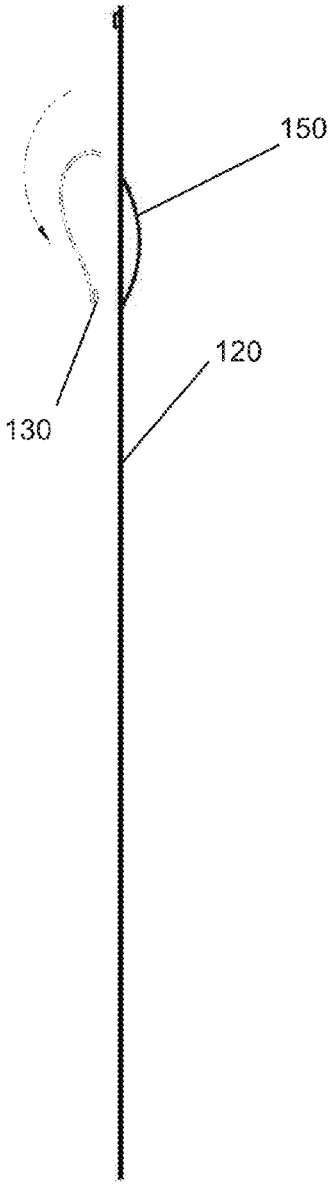
FIG. 4 shows a side view of the towel system.
Figure 5:
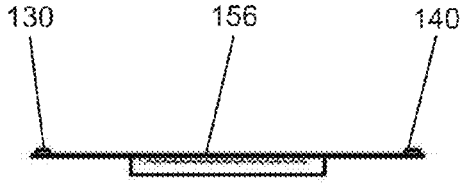
FIG. 5 shows a top view of the towel system.
Figure 6:
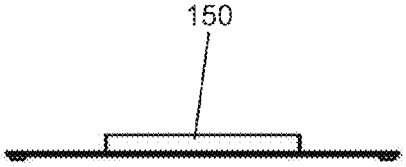
FIG. 6 shows a bottom view of the towel system.
Figure 7:
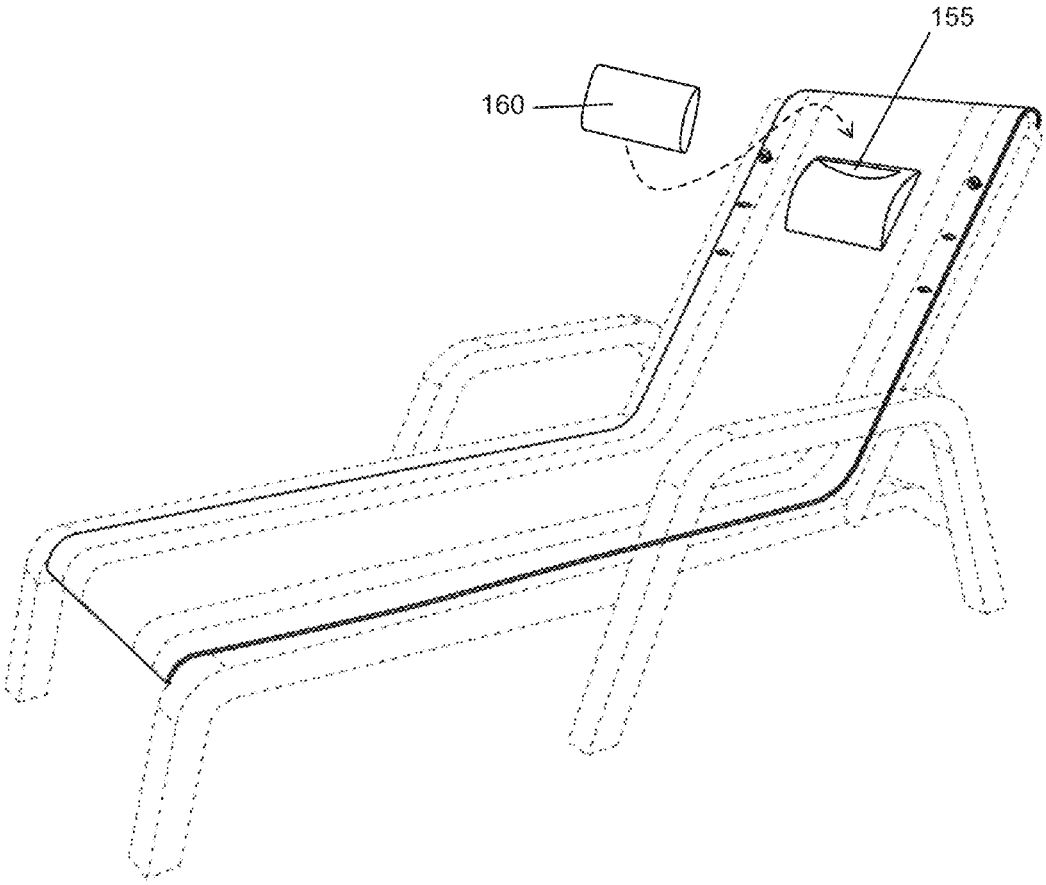
FIG. 7 shows a perspective view of the towel system.
Figure 8:
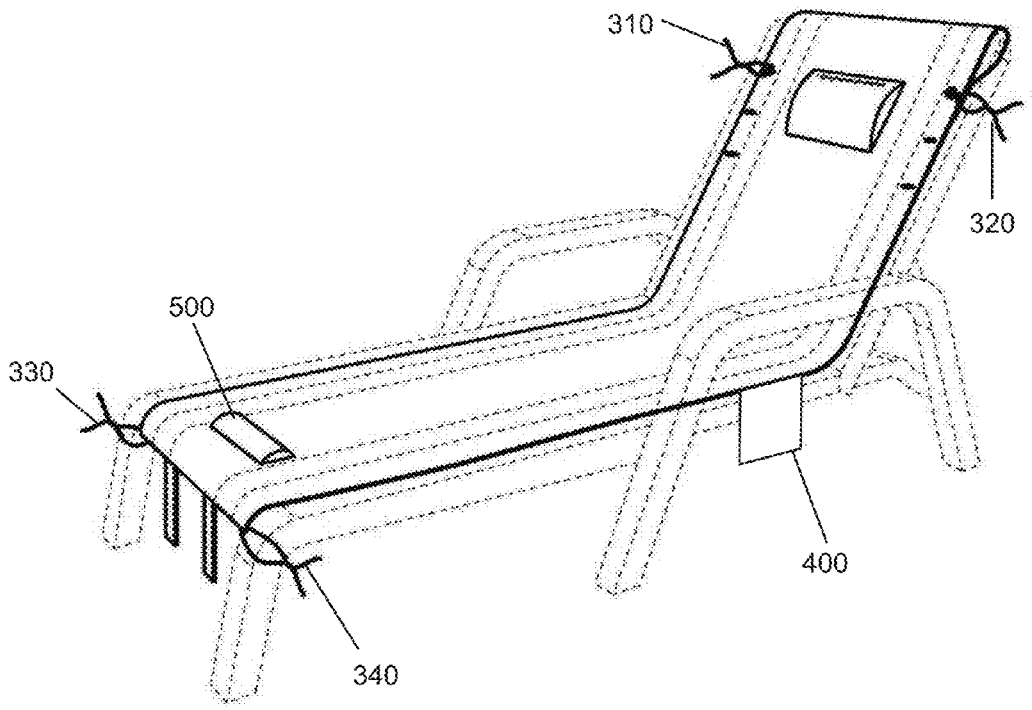
FIG. 8 shows an alternative embodiment of the towel system.
Figure 9:
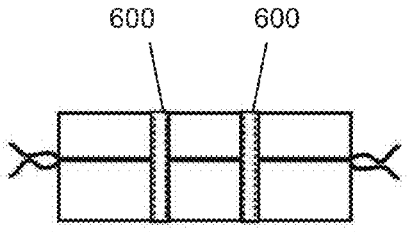
FIG. 9 shows an alternative embodiment of the towel is a rolled-up position.
Figure 10:
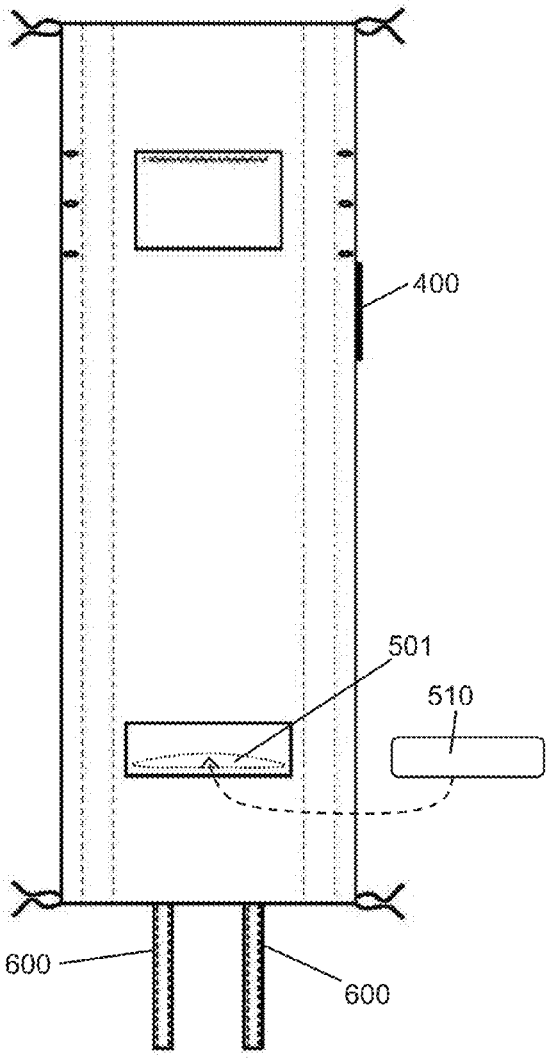
FIG. 10 shows an alternative embodiment of the towel system
Figure 11:
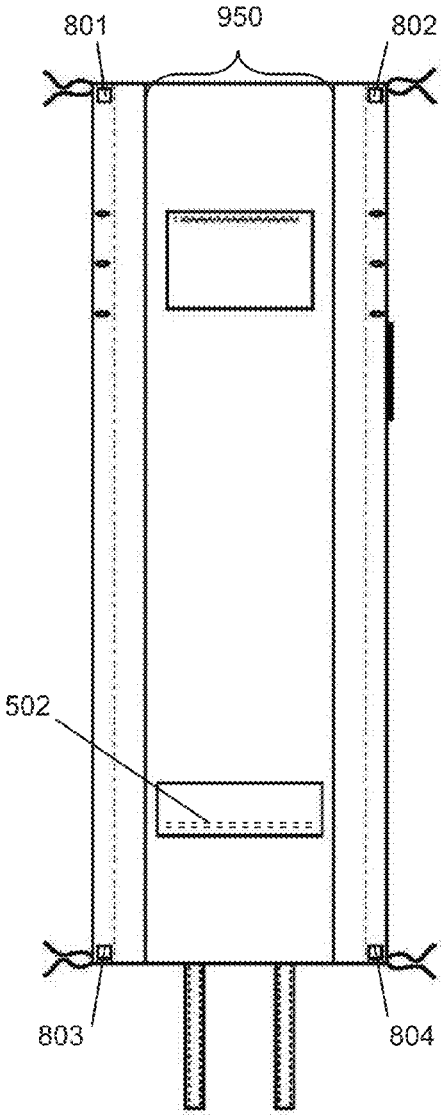
FIG. 11 shows an alternative embodiment of the towel system
Figure 12:
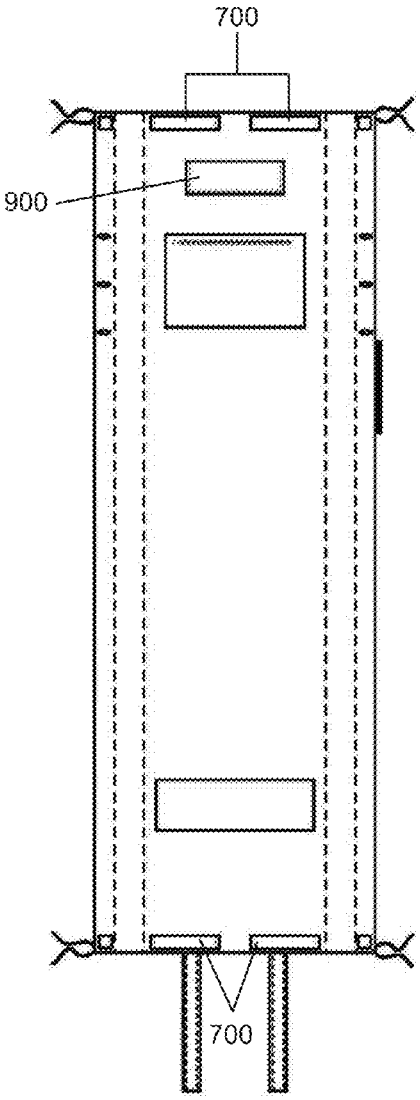
FIG. 12 shows an alternative embodiment of the towel system

Following is a list of elements corresponding to a particular element referred to herein:

100 Towel system
110 Lounge chair
112 Chair back
113 Chair back top edge
114 Chair bottom
116 Chair frame
120 Towel
121 Towel top edge
122 Towel first side
123 Towel second side
124 Towel bottom edge
125 Towel front surface
126 Towel back surface
130 First attachment fastener
140 Second attachment fastener
150 Pillow pouch
151 Pillow pouch top edge
152 Pillow pouch first side
153 Pillow pouch second side
154 Pillow pouch bottom edge
155 Access aperture
156 Closure means
160 Pillow
170 First row of attachment holes
171 First top attachment hole
180 Second row of attachment holes
181 Second top attachment hole
201 First distance
202 Second distance
203 Third distance
204 Fourth distance
205 Fifth distance
300 Towel length
310 First pair of strings
320 Second pair of strings
330 Third pair of strings
340 Fourth pair of strings
400 Pockets
500 Foot pillow pouch
501 Second access aperture
502 Second closure device
510 Foot pillow
600 Securing straps
700 Gripping handles
801 First aperture
802 Second aperture
803 Third aperture
804 Fourth aperture
900 Compartment
950 Cooling towel layer Referring now to FIG. 1-14, the present invention features a towel system (100) with an adjustable padded headrest for laying over a portable lounge chair or directly on a ground surface. The system (100) comprises a portable lounge chair (110) having a chair back (112), a chair bottom (114), and a chair frame (116), wherein the chair back (112) and the chair bottom (114) are disposed on the chair frame (116), and a rectangular towel (120) having a towel top edge (121), a towel first side (122), a towel second side (123), a towel bottom edge (124), a towel front surface (125), and a towel back surface (126).

In some embodiments, a first attachment fastener (130) is disposed on the towel back surface (126) proximal to the towel first side (122) and the towel top edge (121). A second attachment fastener (140) is disposed on the towel back surface (126) proximal to the towel second side (123) and the towel top edge (121). In some embodiments, the first attachment fastener (130) and/or the second attachment fastener (140) is a button, a hook, or a ball bungee cord.

In some embodiments, a pillow pouch (150) comprises a pillow pouch top edge (151), a pillow pouch first side (152), a pillow pouch second side (153), a pillow pouch bottom edge (154), and an access aperture (155). The pillow pouch (150) is disposed on the towel front surface (125) between the towel first side (122) and the towel second side (123).

In some embodiments, the access aperture (155) is disposed at or near the pillow pouch top edge (151). In other embodiments, the access aperture (155) is disposed at or near the pillow pouch bottom edge (154). In some embodiments, the access aperture (155) may comprise a closure device (156). The closure device (156) may be a zipper, a button and hole system, or a hook and loop system.

In some embodiments, a pillow (160) is removeably disposed in the pillow pouch (150). The access aperture (155) may be opened via the closure device (156) for removing the pillow (160) from the pillow pouch (150) or inserting the pillow (160) into the pillow pouch (150).

In some embodiments, a first distance (201) between the towel top edge (121) and the pillow pouch top edge (151) ranges from about 10% to 20% of a length (300) of the towel (120). In other embodiments, the first distance (201) between the towel top edge (121) and the pillow pouch top edge (151) ranges from about 10% to 15% of a length (300) of the towel (120). In still other embodiments, the first distance (201) between the towel top edge (121) and the pillow pouch top edge (151) ranges from about 15% to 20% of a length (300) of the towel (120).

In some embodiments, a first row of attachment holes (170) is disposed on the towel (120) offset from, parallel to, and proximal to the towel first side (122). A second row of attachment holes (180) is disposed on the towel (120) offset from, parallel to, and proximal to the towel second side (123). In some embodiments, a second distance (202) between the towel top edge (121) and a first top attachment hole (171) of the first row of attachment holes (170) ranges from about 10% to 20% of the length (300) of the towel (120). A third distance (203) between the towel top edge (121) and a second top attachment hole (181) of the second row of attachment holes (180) ranges from about 10% to 20% of the length (300) of the towel (120). In other embodiments, the second distance (202) and the third distance (203) ranges from about 10% to 15% of the length (300) of the towel (120). In still other embodiments, the second distance (202) and the third distance (203) ranges from about 15% to 20% of the length (300) of the towel (120).

A fourth distance (204) between any two adjacent attachment holes of the first row of attachment holes (170) ranges from about 5% to 10% of the length (300) of the towel (120). A fifth distance (205) between any two adjacent attachment holes of the second row of attachment holes (180) ranges from about 5% to 10% of the length (300) of the towel (120). In another embodiment, the fourth distance (204) and the fifth distance (205) ranges from about 3% to 8% of the length (300) of the towel (120). In still another embodiment, the fourth distance (204) and the fifth distance (205) ranges from about 8% to 13% of the length (300) of the towel (120).

In preferred embodiments, the towel (120) is disposed on the lounge chair (110) such that towel back surface (126) contacts the chair back (112) and the chair bottom (114). The towel (120) is folded over a chair back top edge (113) such that the towel top edge (121) hangs below the chair back top edge (113). The section where the towel is folded spans from the pillow pouch first side (122) and the pillow pouch second side (123). The section may also be disposed between the pillow pouch (150) and the towel top edge (121). When the towel (120) is folded over a chair back top edge (113), the towel (120) is secured to the lounge chair (110) via the first attachment fastener (130) fastened to any hole of the first row of attachment holes (170) and the second attachment fastener (140) fastened to any hole of the second row of attachment holes (180).

In some embodiments, a first pair of strings (310) is disposed on the towel top edge (121) proximal to the towel first side (122). A second pair of strings (320) is disposed on the towel top edge (121) proximal to the towel second side (123). The towel (120) is secured to the lounge chair (110) via the first pair of strings (310) tied to any hole of the first row of attachment holes (170) and the second pair of strings (320) tied to any hole of the second row of attachment holes (180). In another embodiment, the towel (120) is secured to the lounge chair (110) via the first pair of strings (310) tied to the chair back (112) and the second pair of strings (320) tied to the chair back (112).

In some embodiments, a third pair of strings (330) is disposed on the towel bottom edge (124) proximal to the towel first side (122). A fourth pair of strings (340) is disposed on the towel bottom edge (124) proximal to the towel second side (123), The towel (120) may be fastened to the chair (110) via the third pair of strings (330) and the fourth pair of strings (340) tied to the chair bottom (114).

In some embodiments, the length (300) of the towel (120) ranges from between about 60 inches to 90 inches. In some embodiments, the length (300) of the towel (120) ranges from between about 70 inches to 90 inches. In some embodiments, the length (300) of the towel (120) ranges from between about 80 inches to 100 inches.

In some embodiments, the width of the towel (120) ranges from between about 20 inches to 25 inches. In some embodiments, the width of the towel (120) ranges from between about 25 inches to 30 inches.

In some embodiments, a fabric weight of the towel (120) ranges from about 300 grams per square meter (GSM) to 800 GSM. In some embodiments, the fabric weight of the towel (120) ranges from about 400 GSM to 700 GSM. In a preferred embodiment, the fabric weight of the towel (120) is about 500 GSM.

In some embodiments, one or more pockets (400) are attached to the towel along the towel first side (122), the towel second side (122), or both. The one or more pockets (400) extend away from the towel. When the towel is disposed on the lounge chair (110), the one or more pockets (400) hang downwardly from the towel (120). In preferred embodiments, the one or more pockets (400) are positioned on any of the towel sides such that the one or more pockets (400) are within a comfortable reach from a user. The pockets may be used for storing personal items such as reading materials, lotions, glasses, and cosmetics, or food items such as candy or drinks such as soda or bottled water.

In other embodiments, a water-resistant foot pillow pouch (500) is disposed proximal to the towel bottom edge (124) between the towel first side (122) and the towel second side (123). A second access aperture (501) is disposed on the foot pillow pouch (500). The second access aperture (501) comprises a second closure device (502). In some embodiments, the second closure device (502) comprises a zipper, a button and hole system, or a hook and loop system. In some embodiments, a foot pillow (510) is removeably disposed inside the foot pillow pouch (500). The second access aperture (501) may be opened via the second closure device (502) for removing the pillow (160) from the pillow pouch (150) or inserting the pillow (160) into the pillow pouch (150).

In another embodiment, one or more securing straps (600) are attached to the towel (120) along the towel bottom edge (124) such that the one or more securing straps (600) extend away from the towel (120). When the towel (120) is rolled-up, the one or more securing straps (600) are wrapped around the rolled-up towel (120) to secure it for transport or storage. The one or more securing straps (600) may be elastic. The one or more securing straps (600) may comprise a loop and button system, a hook and loop system, a snap button system, or a tie mechanism for securing the rolled-up towel (120).

In some embodiments, a row of gripping handles (700) is disposed along the towel top edge (121), the towel bottom edge (124), or both. Preferably, the row of gripping handles (700) comprises at least two gripping handles. A user may grasps the gripping handles (700) and shake the towel until any dirt, sand, or debris is removed from the towel. The gripping handles provide the user with a comfortable and secure hold on the towel.

In another preferred embodiment, the towel (120) is alternately disposed directly on a ground surface. Non-limiting examples of a ground surface may be sand at a beach, grass at a park, or a dirt surface.

In some embodiments, a first aperture (801) is disposed proximal to the towel first side (122) and the towel top edge (121), a second aperture (802) is disposed proximal to the towel second side (123) and the towel top edge (121), a third aperture (803) is disposed proximal to the towel first side (122) and the towel bottom edge (124), and a fourth aperture (804) is disposed proximal to the towel second side (123) and the towel bottom edge (124). When the towel (120) is disposed directly on a ground surface, a stake is inserted through each aperture for securing the towel (120) to the ground surface.

In some embodiments, a water-resistant compartment (900) is disposed on the towel front surface (125) between the towel top edge (121) and the pillow pouch (150) and between the towel first side (122) and the towel second side (123). The compartment (900) may be used for storing electronic devices such as phones or media player device. The compartment is conveniently located within a user's reach and away from the user's body to prevent the electronic devices from getting wet. Moreover, as the compartment is located near where a user would place his/her head, the user can easily listen to music from the appropriate electronic device stored in the compartment (900).

In some embodiments, the towel (120) is constructed from cotton, polyester, rayon, bamboo, nonwoven fibers of polyamide or a combination thereof. In other embodiments, the towel (120) is constructed from micro-cotton, hydro-cotton, or Turkish-hydro cotton. In another embodiment, the towel (120) is terrycloth. In still another embodiment, a cooling towel layer (950) is disposed on the towel front surface (125). The cooling towel layer (950) is constructed from polyvinyl alcohol.

In some embodiments, the foot pillow pouch (500) size is about 4 to 8 inches in height by about 12 to 16 inches in width. In some embodiments, the foot pillow pouch (500) size is about 4 inches in height by about 12 inches in width. In some embodiments, the foot pillow pouch (500) size is about 6 inches in height by about 14 inches in width.

In some embodiments, a pillow pouch (150) size is about 8 to 12 inches in height by 12 to 16 inches in width. In some embodiments, a pillow pouch (150) size is about 10 inches in height by 14 inches in width. In some embodiments, a pillow pouch (150) size is about 8 inches in height by 12 inches in width.

In some embodiments, the pillow (160) comprises a filler constructed from air, polyester, beanbag beans, down, or memory foam. In some embodiments, the foot pillow (510) comprises a filler constructed from air, polyester, beanbag beans, down, or memory foam.

Figure 13:
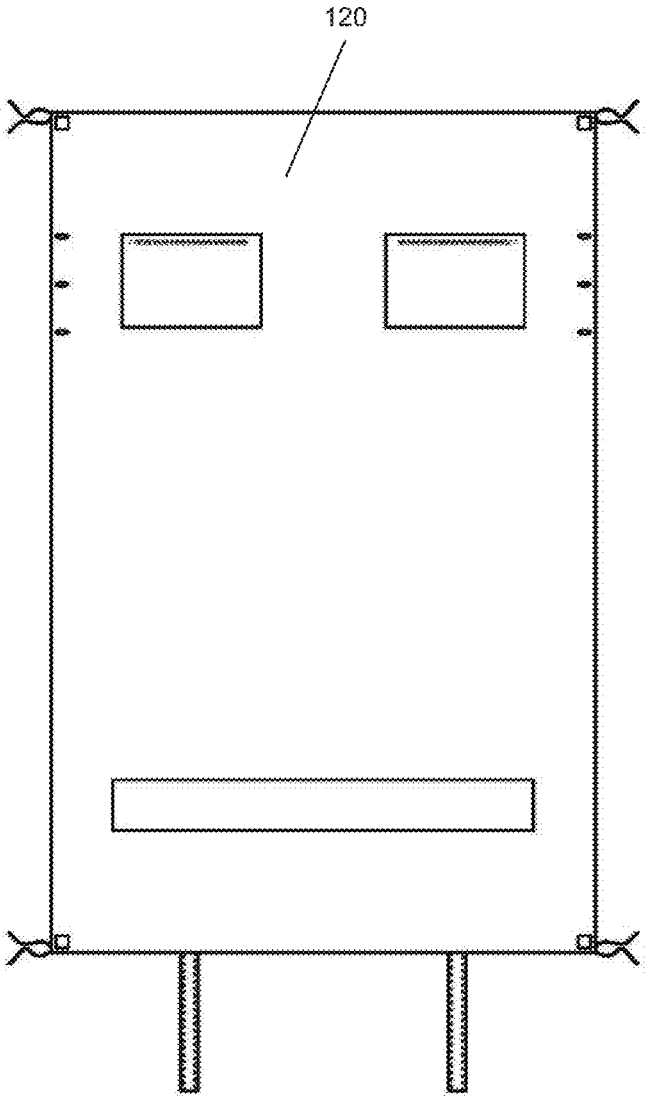
FIG. 13 shows an alternative embodiment of the towel system

In alternate embodiments, the towel may be constructed to fit multiple users. As shown in FIG. 13, the towel system (100) may be upsized to comfortably fit two people. The system (100) may comprise a second pillow pouch adjacent to and in line with the first pillow pouch (150). The system (100) may further comprise a second foot pillow pouch adjacent to and in line with the first foot pillow pouch (500).

Figure 14:
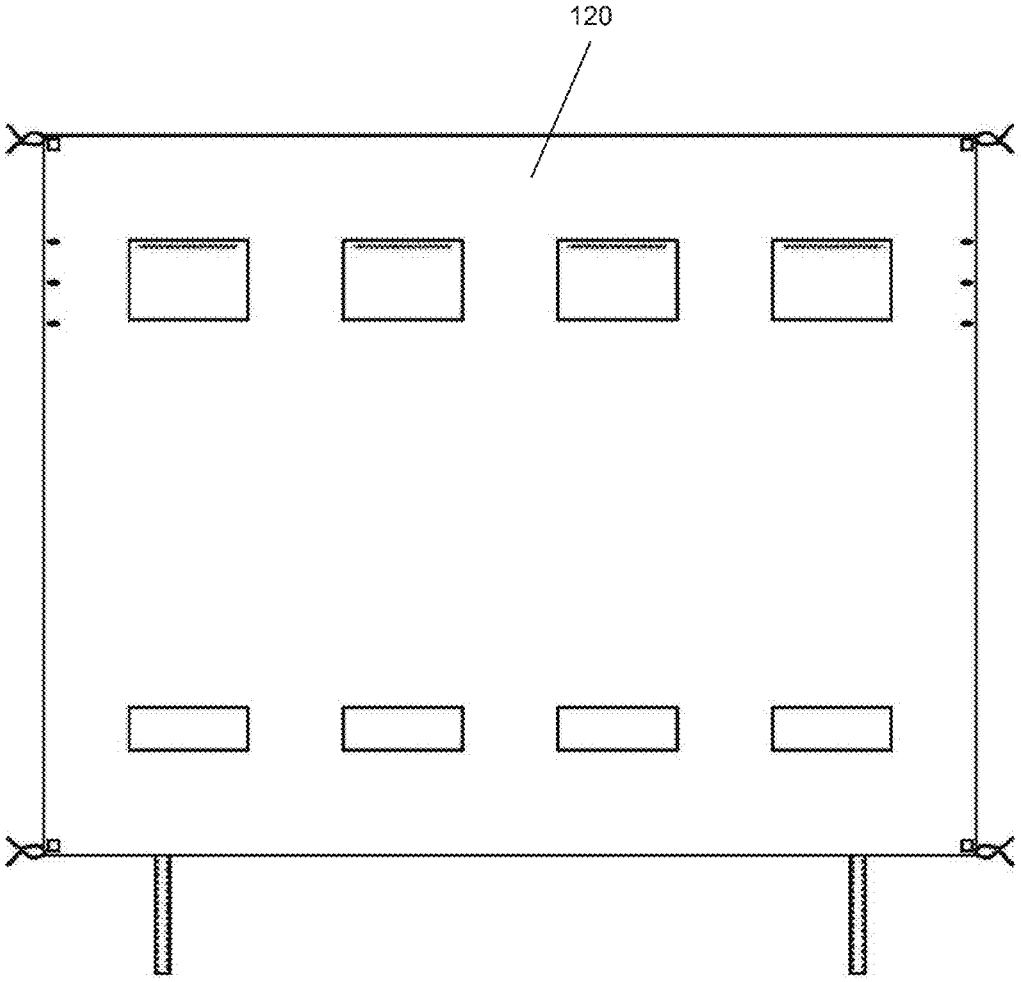
FIG. 14 shows an alternative embodiment of the towel system

As shown in FIG. 14, in an alternate embodiment, the towel system (100) may be upsized to comfortably fit a family of about 3 to 5 people. The system (100) may comprise at least two or more pillow pouches adjacent to and in line with the first pillow pouch (150). The system (100) may further comprise at least two or more foot pillow pouches adjacent to and in line with the first foot pillow pouch (500).

In some embodiments a logo, wording, or image may be disposed on the towel (120). As non-limiting examples, the logo may from an establishment such as a hotel, or the wording may be the initials or name of the owner of towel, or the image may be any design preferred by the owner of the towel.

As used herein, the term "about" refers to plus or minus 10% of the referenced number.

The disclosures of the following U.S. Patents are incorporated in their entirety by reference herein: U.S. Pat. No. D 389,362; U.S. Pat. No. D 349,625; U.S. Pat. No. D 322,532; U.S. Pat. No. D 280,170; U.S. Pat. No. 6,058,530; U.S. Pat. No. 5,729,846; U.S. Pat. No. 5,467,487; U.S. Pat. No. 5,361,435; U.S. Pat. No. 5,072,467; and U.S. Pat. No. 4,200,942.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A towel system (100) with an adjustable padded headrest for laying over a portable lounge chair, wherein the system (100) consists of:

(a) the portable lounge chair (110) consisting of a chair back (112), a chair bottom (114), and a chair frame (116), wherein the chair back (112) and the chair bottom (114) are disposed on the chair frame (116);

(b) a rectangular towel (120) consisting of a towel top edge (121), a towel first side (122), a towel second side (123), a towel bottom edge (124), a towel front surface (125), and a towel back surface (126);

(c) a first attachment fastener (130) disposed on the towel back surface (126) proximal to the towel first side (122) and the towel top edge (121), wherein the first attachment fastener (130) consists of a first button permanently and directly attached to the towel back surface (126);

(d) a second attachment fastener (140) disposed on the towel back surface (126) proximal to the towel second side (123) and the towel top edge (121), wherein the second attachment fastener (140) consists of a second button permanently and directly attached to the towel back surface (126);

(e) a pillow pouch (150) consisting of a pillow pouch top edge (151), a pillow pouch first side (152), a pillow pouch second side (153), a pillow pouch bottom edge (154), and an access aperture (155), wherein the pillow pouch (150) is disposed on the towel front surface (125) between the towel first side (122) and the towel second side (123), wherein a first distance (201) between the towel top edge (121) and the pillow pouch top edge (151) ranges from about 10% to 20% of a length (300) of the towel (120), wherein the access aperture (155) is disposed at or near the pillow pouch top edge (151), wherein the access aperture (155) consists of a closure device (156);

(f) a pillow (160) removeably disposed in the pillow pouch (150); and (g) a first row of attachment holes (170) disposed on the towel (120) offset from, parallel to, and proximal to the towel first side (122), wherein a second row of attachment holes (180) is disposed on the towel (120) offset from, parallel to, and proximal to the towel second side (123), wherein a second distance (202) between the towel top edge (121) and a first top attachment hole (171) of the first row of attachment holes (170) ranges from about 10% to 20% of the length (300) of the towel (120), wherein a third distance (203) between the towel top edge (121) and a second top attachment hole (181) of the second row of attachment holes (180) ranges from about 10% to 20% of the length (300) of the towel (120), wherein a fourth distance (204) between any two adjacent attachment holes of the first row of attachment holes (170) ranges from about 5% to 10% of the length (300) of the towel (120), wherein a fifth distance (205) between any two adjacent attachment holes of the second row of attachment holes (180) ranges from about 5% to 10% of the length (300) of the towel (120);

wherein the towel (120) is disposed on the lounge chair (110) such that towel back surface (126) contacts the chair back (112) and the chair bottom (114), wherein the towel (120) is folded over a chair back top edge (113) such that the towel top edge (121) hangs below the chair back top edge (113), wherein the towel (120) is secured to the lounge chair (110) via the first attachment fastener (130) fastened to any hole of the first row of attachment holes (170) and the second attachment fastener (140) fastened to any hole of the second row of attachment holes (180).

2. The system (100) of claim 1, wherein the length (300) of the towel (120) ranges from between about 60 inches to 90 inches.

3. The system (100) of claim 1, wherein the closure device (156) consists of a zipper.

4. The system (100) of claim 1, wherein the towel (120) is constructed from terrycloth, cotton, polyester, rayon, or a combination thereof.

* * * * *